US009605448B2

(12) United States Patent
Leyden

(10) Patent No.: US 9,605,448 B2
(45) Date of Patent: Mar. 28, 2017

(54) SECURITY SYSTEM FOR CANDLES

(71) Applicant: Se-Kure Controls, Inc., Franklin Park, IL (US)

(72) Inventor: Roger J. Leyden, Inverness, IL (US)

(73) Assignee: Se-Kure Controls, Inc., Franklin Park, IL (US)

( * ) Notice: Subject to any disclaimer, the term of this patent is extended or adjusted under 35 U.S.C. 154(b) by 146 days.

(21) Appl. No.: 14/793,169

(22) Filed: Jul. 7, 2015

(65) Prior Publication Data

US 2017/0009492 A1 Jan. 12, 2017

(51) Int. Cl.

| | |
|---|---|
| ***F21L 19/00*** | (2006.01) |
| ***F21V 35/00*** | (2006.01) |
| ***E05B 73/00*** | (2006.01) |
| ***C11C 5/00*** | (2006.01) |

(52) U.S. Cl.

CPC ..... *E05B 73/0023* (2013.01); *C11C 5/00* (2013.01)

(58) Field of Classification Search

CPC ..... F05B 73/0023; C11C 5/00
USPC ..... 362/161, 810, 458
See application file for complete search history.

(56) References Cited

U.S. PATENT DOCUMENTS

| | | | | |
|---|---|---|---|---|
| 757,118 | A | | 4/1904 | Hubert |
| 859,825 | A | | 7/1907 | Mann |
| 3,151,756 | A | | 10/1964 | Gruen |
| 3,386,273 | A | | 6/1968 | Green |
| 3,893,581 | A | | 7/1975 | Kapphahn |
| 4,240,237 | A | | 12/1980 | Alduk et al. |
| 4,495,486 | A | | 1/1985 | White |
| 4,723,370 | A | | 2/1988 | Sheehan |
| 5,306,062 | A | | 4/1994 | Dodge |
| 6,034,024 | A | * | 3/2000 | Krzystowczyk ..... C08F 10/00 502/103 |
| 6,137,413 | A | | 10/2000 | Ryan, Jr. |
| 6,342,838 | B1 | | 1/2002 | Kolton et al. |
| 6,696,955 | B2 | | 2/2004 | Kolton et al. |
| 7,267,250 | B2 | | 9/2007 | Rudduck et al. |
| 7,583,194 | B2 | | 9/2009 | Appalucci et al. |
| 8,049,628 | B2 | | 11/2011 | Arrighi |
| 8,400,301 | B1 | | 3/2013 | Kersch et al. |
| 2007/0146141 | A1 | | 6/2007 | Popplewell et al. |
| 2009/0135015 | A1 | | 5/2009 | Dobson et al. |
| 2012/0103863 | A1 | | 5/2012 | Perez et al. |

(Continued)

*Primary Examiner* — Anh Mai
*Assistant Examiner* — Glenn Zimmerman
(74) *Attorney, Agent, or Firm* — Wood, Phillips, Katz, Clark & Mortimer

(57) ABSTRACT

The combination of a candle and a security assembly. The candle has a case, bounding a receptacle for a supply of wax, with a main body and a neck. The neck defines an opening into the receptacle. The case defines a shoulder facing in a first direction. The security assembly is configured to be placed in first and second different states. The security assembly in the first state is configured to be directed through the neck generally in the first direction up to and past the shoulder into a securing position. The security assembly in the first state and securing position is changeable into the second state wherein the security assembly is blocked by the shoulder from being moved generally oppositely to the first direction through the neck to be separated from the case. The security assembly in its second state is configured to accommodate an accessible portion of an embedded wick.

34 Claims, 10 Drawing Sheets

(56) References Cited

U.S. PATENT DOCUMENTS

2015/0061871 A1 3/2015 Davies

* cited by examiner

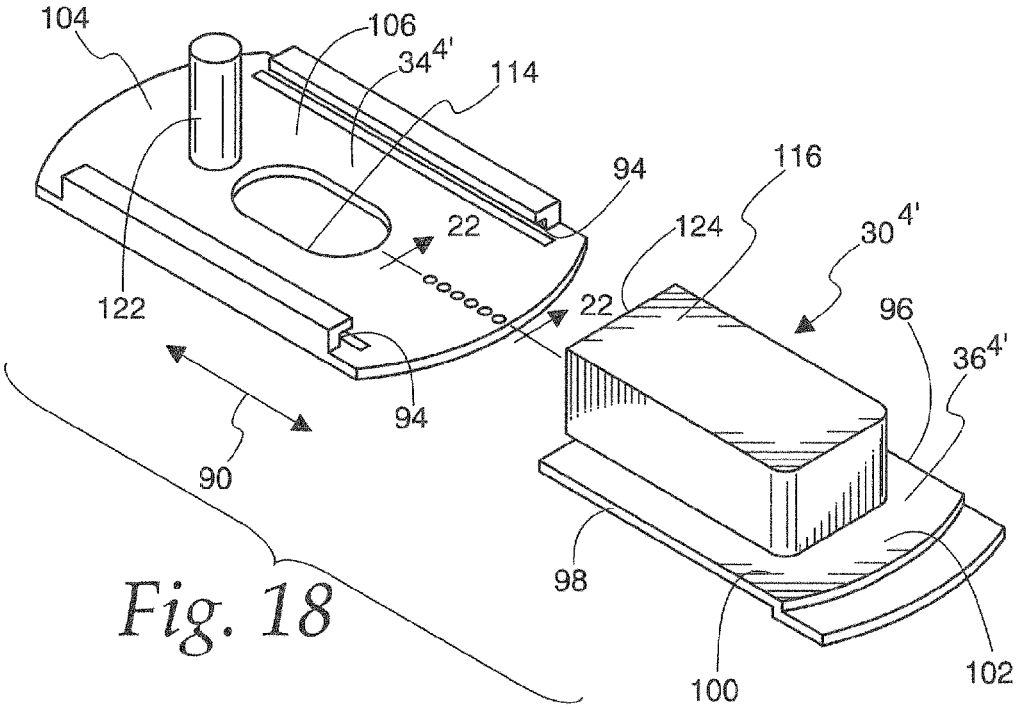
Fig. 18
Fig. 19
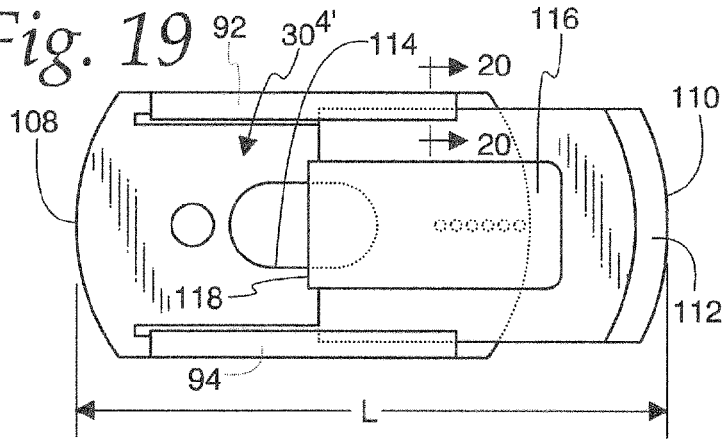
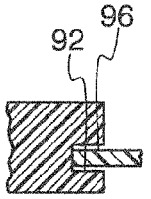
Fig. 20
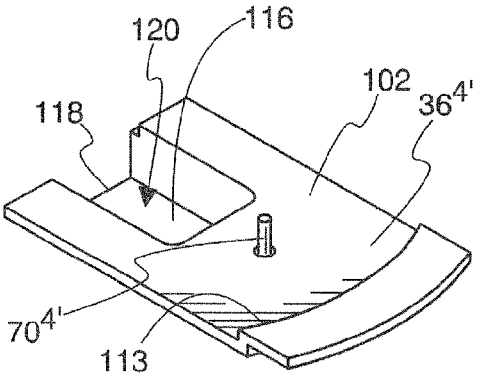
Fig. 21

Fig. 28
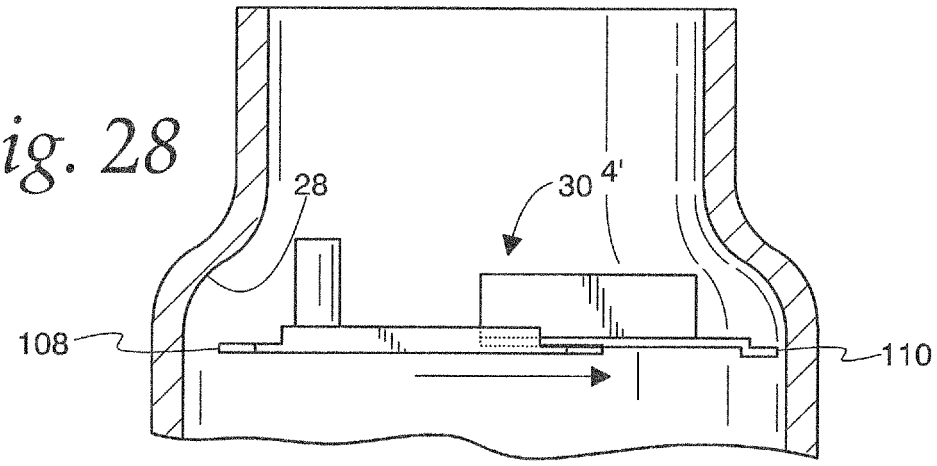
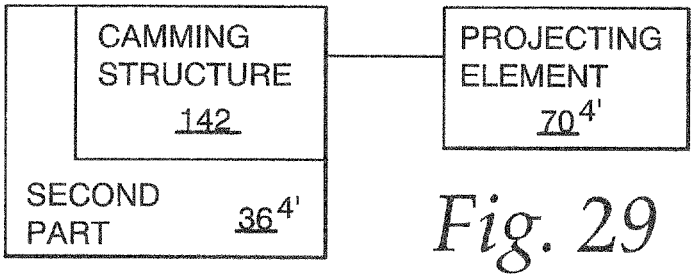
Fig. 29
Fig. 31
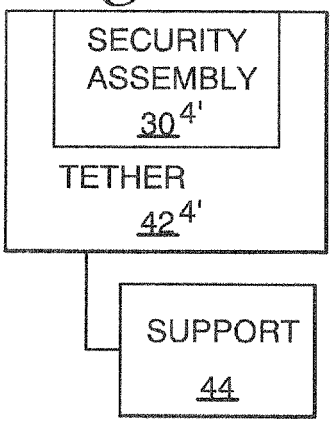
Fig. 30
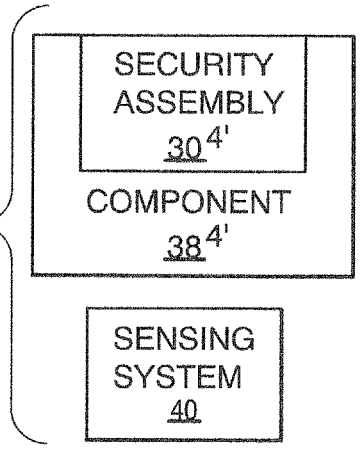

SECURITY SYSTEM FOR CANDLES

BACKGROUND OF THE INVENTION

Field of the Invention

This invention relates to security systems and, more particularly, to a security system for candles with a container within which wax is contained.

Background Art

Candles are becoming increasingly popular. With this increased popularity has come an energized industry that has invested in new technologies and designs. Dedicated candle shops are becoming more common nationwide. Those stores that have offered candles in the past are generally increasing their volume and selection of candles.

One particularly popular candle design is one using a container/case, made typically of glass, that defines a receptacle within which a quantity of wax is confined. One common container shape incorporates a base that tapers to a neck that opens at the top of the container. The base is typically cylindrical in shape and blends into the neck.

A cap is configured to be pressed into the top of the neck and seals the container to thereby control the escape of scented vapors, which is desirable when the candle is being transported and displayed for sale. Further, end users may at times wish to confine the scent in homes and businesses. The cap may be frictionally held or otherwise held, as by threads, so as to allow it to be readily secured at the neck and released from the container.

The evolution of the candle industry has caused the generation of many versions of the above type of candle that are relatively expensive. Thus, as with all consumer displayed articles having significant value, they become targets of thieves. Candles of the above type commonly are dimensioned such that they might be put in coat pockets and removed from sales establishments without detection.

Given the shape of the candle containers, they do not lend themselves to being readily monitored or altered so that they are less appealing to thieves. As a result, the candle industry has sustained, and continues to sustain, significant losses from theft, with there being an expectation that this trend will continue.

The candle industry is at a stage where practical systems for minimizing theft are needed. However, with the rapid growth of this industry, the implementation of effective security measures has lagged.

SUMMARY OF THE INVENTION

In one form, the invention is directed to the combination of a candle and a security assembly. The candle has a case bounding a receptacle for a supply of wax in which a wick is embedded. The wick has an accessible portion. The case has a main body and a neck. The neck defines an opening into the receptacle. The opening has a first effective diameter. The case defines a shoulder facing in a first direction with a second effective diameter that is greater than the first effective diameter. The security assembly is configured to be placed in first and second different states. The security assembly in the first state is configured to be directed through the neck generally in the first direction up to and past the shoulder into a securing position. The security assembly in the first state and securing position is changeable into the second state wherein the security assembly has a third effective diameter that is greater than the first effective diameter so that the security assembly is blocked by the shoulder from being moved generally oppositely to the first direction through the neck to be separated from the case. The security assembly is configured to accommodate the accessible portion of the wick with the security assembly in the second state.

In one form, the candle and a security assembly are further provided in combination with a sensing system. The security assembly further includes a component that is configured to be detected by the sensing system to thereby allow monitoring of the candle with the security assembly in the securing position and second state.

In one form, the security assembly has first and second parts that are movable one relative to the other to thereby change the security assembly between the first and second states.

In one form, the security assembly is configured so that the first and second parts are movable guidingly relative to each other along a first line.

In one form, the candle and security assembly are further provided in combination with a removable cap that is configured to be selectively: a) engaged with the case to block the neck opening; and b) separated from the case.

In one form, the case has a top and bottom. The neck opening is at the top of the case.

In one form, the case is made from a glass material.

In one form, the security assembly further includes a tether attached to one of the first and second parts and having a length. The tether is configured to be secured to a support to confine movement of the candle to within a range determined by the length of the tether.

In one form, the security assembly has an EAS tag.

In one form, the main body has a substantially cylindrical shape with a first central axis. The neck has a substantially cylindrical shape with a second central axis that is substantially coincident with the first central axis.

In one form, the neck blends into the main body at a first transition location at which the shoulder is defined.

In one form, the security assembly further includes a locking assembly configured when in a locked state to maintain the first and second parts in a relationship wherein the security assembly is in the second state.

In one form, the locking assembly has a projecting element on one of the first and second parts that blocks relative movement between the first and second parts with the locking assembly in the locked state.

In one form, the projecting element is configured to be retracted to change the locking assembly from the locked state into a released state wherein the first and second parts can be moved relative to each other to thereby change the security assembly from the second state into the first state.

In one form, the candle and security assembly are further provided in combination with a tool that produces a magnetic force. The projecting element is configured to be retracted in response to the application of a magnetic force by the tool.

In one form, the first and second parts each consists of a substantially flat plate, with the plates residing in spaced, substantially parallel planes. The first and second parts are movable relative to each other while maintaining a substantially parallel relationship between the planes within which the first and second parts reside.

In one form, the first and second parts are fully separate parts movable independently of each other.

In one form, the first and second parts cooperatively produce an overall flat shape with a combined length along the first line, as viewed along a line normal to a plane of the flat shape, that is changed as the security assembly is changed between the first and second states.

In one form, the security assembly further includes a locking assembly configured when in a locked state to maintain the first and second parts in a relationship wherein the security assembly is in the second state.

In one form, the locking assembly is configured when in the locked state to maintain the first and second parts in a plurality of different relationships wherein the security assembly is in the second state and the combined lengths of the first and second parts along the first line are different.

In one form, one of the first and second parts has a cantilevered post that can be grasped to control positioning of the one of the first and second parts.

In one form, there are rail and slot components on the first and second parts that cooperate to guide relative movement between the first and second parts.

In one form, the security assembly has an opening that is located to receive the accessible portion of the wick with the security assembly in the second state.

In one form, the security assembly has a chamber located to receive the accessible portion of the wick with the security assembly in the second state.

In one form, there is an opening in one of the first and second parts that is located to receive the accessible portion of the wick with the security assembly in the second state.

In one form, one of the first and second parts has a chamber located to receive the accessible portion of the wick with the security assembly in the second state.

In one form, the other of the first and second parts has a chamber located to receive the accessible portion of the wick with the accessible portion of the wick projecting through the opening in the one of the first and second parts with the security assembly in the second state.

In one form, the security assembly is configured so that the first and second parts are movable guidingly relative to each other along a first line.

In one form, the locking assembly has a projecting element on one of the first and second parts and a plurality of spaced openings on the other of the first and second parts each to receive the projecting element with the, first and second parts in different relationships.

In one form, the security assembly is configured so that the projecting element can be selectively extended and retracted.

In one form, the security assembly is configured so that the projecting element is biased into an extended position.

In one form, the projecting element is configured to be attracted to a magnet that can be placed in the vicinity of the projecting element to thereby retract the projecting element against a force biasing the projecting element into the extended position.

In one form, a magnet is provided that is usable to retract the projecting element.

In one form, the first and second parts are configured so that portions of the first and second parts abut to fix a combined dimension of the first and second parts along the first line.

BRIEF DESCRIPTION OF THE DRAWINGS

FIG. 18 is an exploded perspective view of a further modified form of security assembly, according to the present invention, and including separate joinable parts;

FIG. 19 is a plan view of the parts in FIG. 18 in a joined state;

FIG. 20 is a fragmentary, cross-sectional view of a slot and rail arrangement connecting between the parts and taken along line 20-20 of FIG. 19;

FIG. 21 is a bottom perspective view of one of the parts on the security assembly in FIGS. 18-20;

FIG. 28 is a view as in FIG. 27 with the security assembly in its securing position and second state and thereby fixed to the candle;

FIG. 29 is a schematic representation of a modified form of locking assembly for the parts on the security assembly in FIGS. 18-28;

FIG. 30 is a view of components as in FIG. 3 adapted to the security assembly configuration of FIGS. 18-28; and FIG. 31 is a view of components as in FIG. 4 adapted to the security assembly configuration of FIG. 18-28.

DETAILED DESCRIPTION OF THE PREFERRED EMBODIMENT

Figure 1:
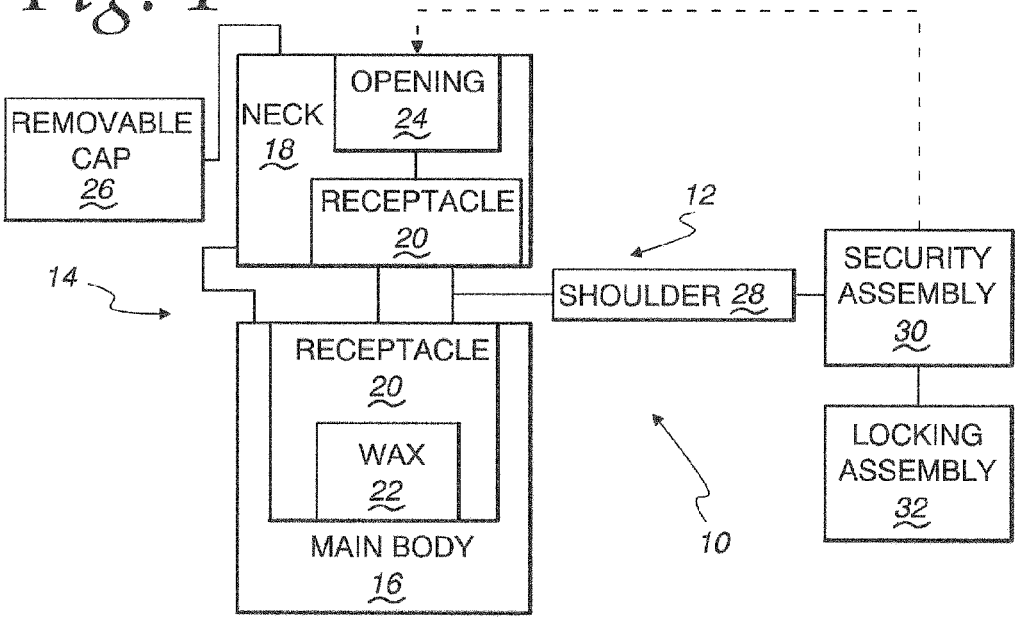
FIG. 1 is a schematic representation of a system made up of a conventional type candle and a security assembly with a locking assembly, according to the present invention.

FIG. 1 is a schematic representation of a system 10, according to the invention. The system 10 includes a candle at 12 having a case 14, made up of a main body 16 and neck 18 cooperatively bounding a receptacle 20 for a supply of wax 22. The neck 18 defines an opening 24 into the receptacle 20 and that has a first effective diameter. The opening 24 is selectively closed by a removable cap 26.

A shoulder 28 is defined within the receptacle 20 either in the neck 18, the main body 16, or at the location where they merge. The shoulder 28 faces in a first direction and has a second effective diameter that is greater than the first effective diameter.

The system 10 further includes a security assembly 30 that is configured to be placed in first and second different states. In the first state, the security assembly 30 is configured to be directed through the neck 18, generally in the aforementioned first direction, up to and past the shoulder 28 into a securing position. The security assembly 30 in the first state and securing position is changeable into the second state wherein the security assembly 30 has a third effective diameter, that is greater than the first effective diameter, so that the security assembly 30 is blocked by the shoulder 28 from being moved oppositely to the first direction through the neck 18, and opening 24 thereon, to be separated from the case 14.

The nature of the security assembly 30 is not specifically limited, as it may take any configuration that is changeable to have the aforementioned first and second different states. This reconfiguration may be effected by relatively moving parts, reconfiguration of individual parts, as through inflation, etc. The examples below are only exemplary in nature.

Figure 2:
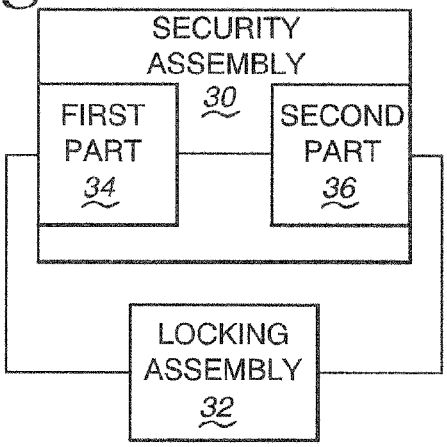
FIG. 2 is a schematic representation of the security assembly and locking assembly in FIG. 1 and showing a more specific form thereof including first and second relatively movable parts.
Figure 3:
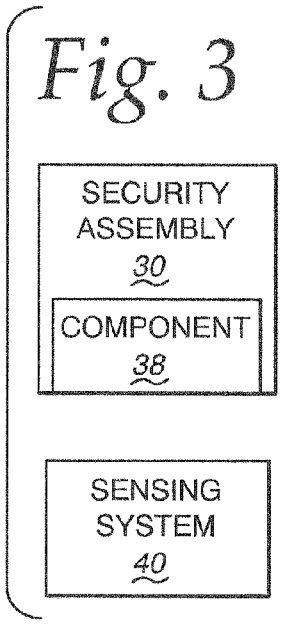
FIG. 3 is a schematic representation of the security assembly in FIG. 1 and showing a component thereon that is configured to cooperate with a sensing system configured to detect the presence of an associated candle.
Figure 4:
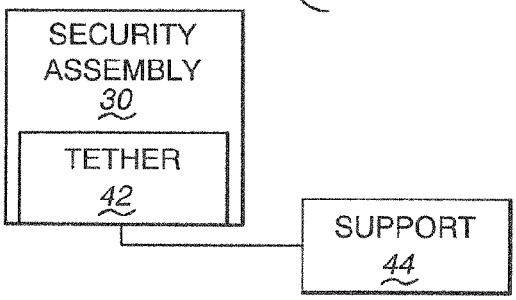
FIG. 4 is a schematic representation as in FIG. 3 wherein a tether is provided to connect the security assembly to a support to confine movement of an associated candle.
Figure 5:
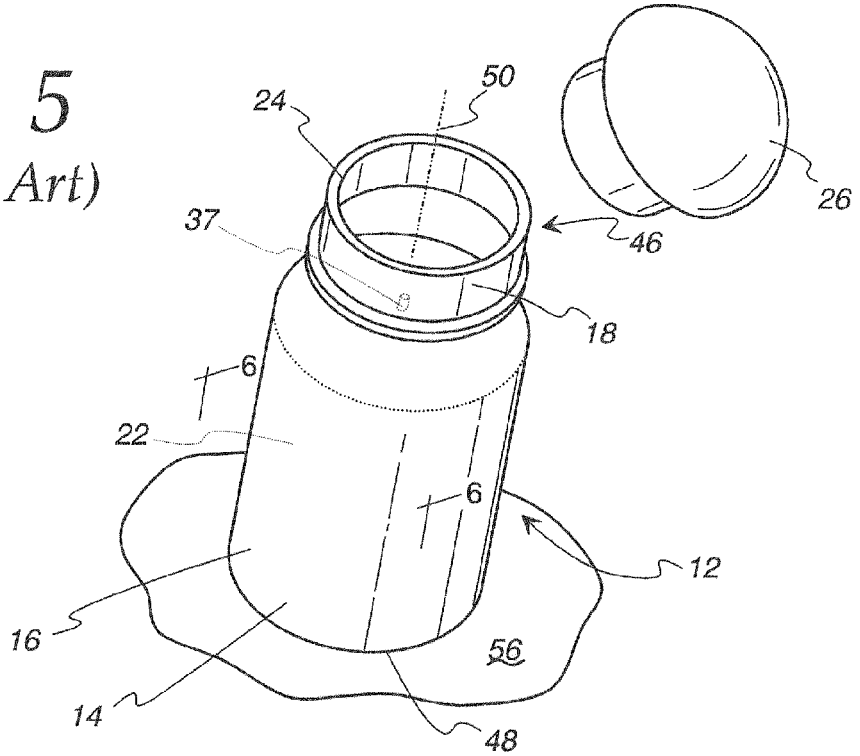
Fig. 5 (Prior Art)
FIG. 5 is an exploded, perspective view of a conventional-type candle with which the inventive security assembly is usable.

The schematic showing in FIG. 1, and additionally in FIGS. 2-4, is intended to encompass the specific embodiments, described herein, and virtually an unlimited number of variations of the components therein, and their interaction, consistent with the overall inventive concept.

A locking assembly 32, of any suitable form, may be considered to be part of the security assembly 30, or separate therefrom, and is constructed to maintain one or both of the first and second different states for the security assembly 30.

In one exemplary form, as shown schematically in FIG. 2, the security assembly 30 consists of first and second parts 34, 36, respectively, which are movable, one relative to the other, to change the security assembly 30 between its first and second states. The locking assembly 32 is usable to maintain at least the second state.

As noted above, the first and second parts 34, 36 can take a wide range of different configurations. Additional parts can cooperate between or with the first and/or second parts 34, 36.

Figure 6:
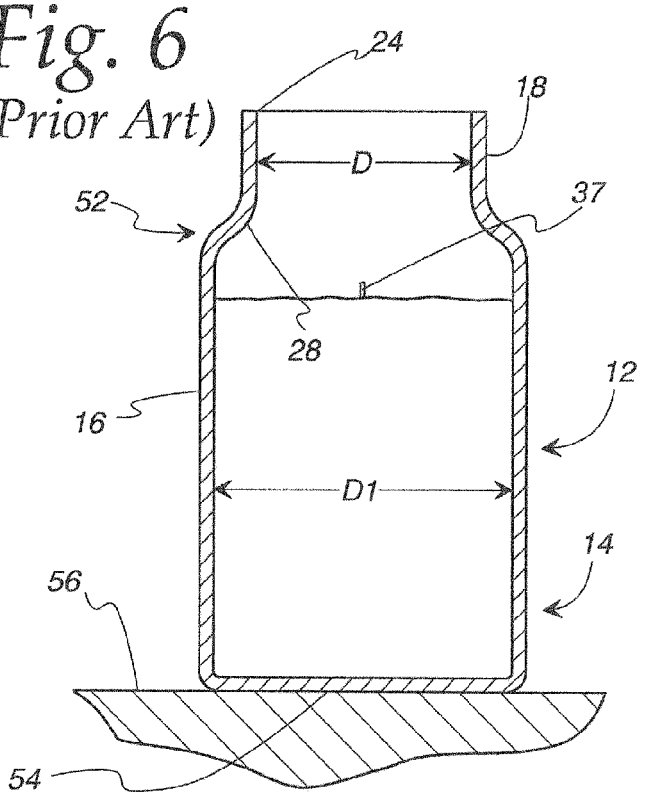
Fig. 6 (Prior Art)
FIG. 6 is a cross-sectional view of the candle taken along line 6-6 of FIG. 5.

The security assembly 30, by being maintained in its securing position, overlies the wax and an accessible portion of a wick 37 (FIG. 6) embedded therein to altogether prevent, or at least impair, normal use of the candle 12 by lighting the accessible wick portion at the top surface of the wax supply. Thus, the mere existence of the security assembly 30 affords a level of security by reason of providing "benefit denial".

Alternatively, as shown in FIG. 3, a component 38 may be integrated into the security assembly 30. The component 38 is configured to be detected by a sensing system 40 to thereby allow monitoring of the candle 12 with the security assembly 30 in the securing position and second state. The component 38 may be an EAS tag or other type of component.

As a further alternative form as shown in FIG. 4, the security assembly 30 may incorporate a tether 42, attached as to the first and/or second parts 34, 36 as shown in FIG. 2. The tether 42 has a length and is configured to be attached to a support 44 whereby the tether 42 confines movement of the candle 12, with which the security assembly 30 is associated, to confine movement of the candle 12 within a range determined by the length of the tether 42.

One specific, and exemplary, form of the security assembly 30 will be described with reference to FIGS. 5-13 for an associated exemplary candle 12. In this embodiment, the candle 12 has a case 14 with a common shape typically made from a glass material. The case 14 has a top 46 and bottom 48. The neck 18 and the opening 24 therein are at the top of the case 14.

In this embodiment, the main body 16 has a substantially cylindrical shape with a central, vertical axis 50. The neck 18 likewise has a substantially cylindrical shape and shares the central axis 50. The central axis of the neck 18 could be non-coincident with the central axis 50.

The cap 26 is configured to be selectively: a) engaged with the case 14 at the neck 18 to block the neck opening 24; and b) fully separated from the case 14. A sealing structure may be provided between the cap 26 and case 14 to capture scented vapor to extend the useful life of the candle 12.

The neck 18 blends into the main body 16 at a transition location at 52 at which the shoulder 28 is defined. The shoulder 28 has an annular shape that faces axially downwardly, i.e., in the aforementioned first direction.

In this embodiment, the diameter of the inside of the neck 18 is indicated at D. The precise diameter is not critical. The diameter D1 of the main body 16 is identified as D1 and is larger than D and large enough so that the bottom surface 54 of the main body 16 stably supports the candle 12 upon an upright support 56. It is not necessary that the diameters D, D1 be uniform in the neck 18 and main body 16.

Overall, the precise relative dimensions of the candle case 14 are not critical to the present invention. The shoulder 28, whether located in the neck 18 or main body 16, or at the transition therebetween as shown, has an "effective diameter" greater than the "effective diameter" at D. Accordingly, the security assembly 30 can be directed through the upper neck opening 24 in its first state, wherein it has a first effective diameter, past the shoulder 28 into the securing position therefor, whereupon it can be reconfigured to be placed in the second state, in which it has a second effective diameter that is larger than the first effective diameter. As a result, the security assembly 30 is blocked by the shoulder 28 from being backed out of the neck 18 and separated from the case 14.

The exemplary security assembly 30 is shown wherein the aforementioned first and second parts 34, 36 are shown in the form of generally flat plates that are placed one over the other so that separate planes P1, P2, within which the parts 34, 36, respectively reside, are substantially parallel to each other. Thus, the combined parts 34, 36 together have an overall flat shape.

In this embodiment, each of the parts 34, 36 has an overall "I" shape, with a vertical stem S and spaced cross pieces CP.

The parts 34, 36 are joined through a post, or in this case through a hollow sleeve 58, for guided relative movement about an axis 60 normal to the planes P1, P2.

Figure 9:
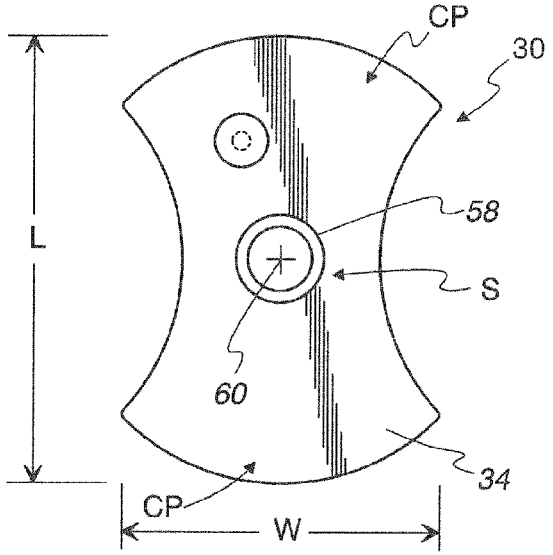
FIG. 9 is an enlarged, plan view of the inventive security assembly in a first state in which it can be directed into the securing position and separated therefrom.

The first state for the security assembly 30 is shown in FIG. 9, wherein the shapes of the parts 34, 36 are matched so that the combined area occupied by the parts 34, 36, as viewed along the axis 60, is approximately the area occupied by either one of the parts 34, 36.

Figure 7:
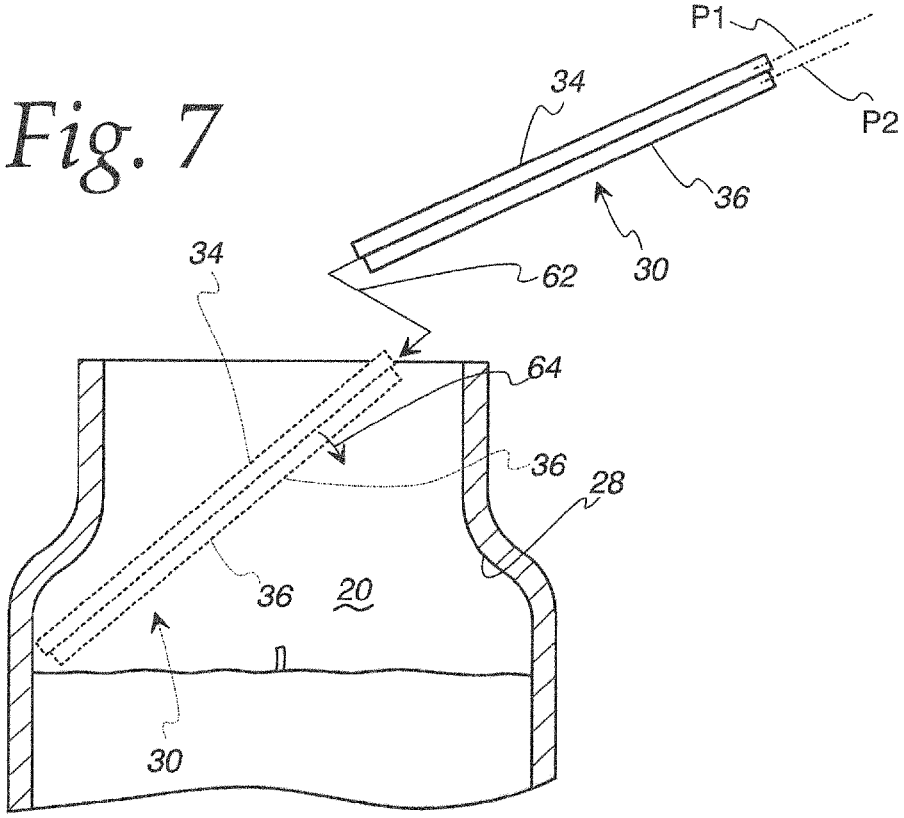
FIG. 7 is a fragmentary view of the cross-sectioned candle, as shown in FIG. 6, and with one form of security assembly, according to the invention, being directed through a neck on the candle into a securing position within a receptacle on the candle.

The overlying parts 34, 36 in the first state therefor have a width W that is substantially less than the diameter D whereby the security assembly 30 can be angled, as shown in FIG. 7, and advanced in the direction of the arrow 62 through the neck 18 and into the portion of the receptacle 20 bounded by the larger diameter main body 16. The length L of the security assembly 30 is selected, based upon the sizes of the neck 18 and body 16, so that the angled security assembly 30 can be advanced into the dotted line position of FIGS. 7 and 8, whereupon it can be tipped downwardly at one end in the direction of the arrow 64, without being blocked by the neck 18, to assume the solid line position of FIG. 8, which is the aforementioned securing position. This position is finally realized by shifting the security assembly 30 radially as indicated by the arrow 66 in FIG. 8, once the security assembly 30 has been tipped downwardly to reside fully beneath the shoulder 28.

Figure 8:
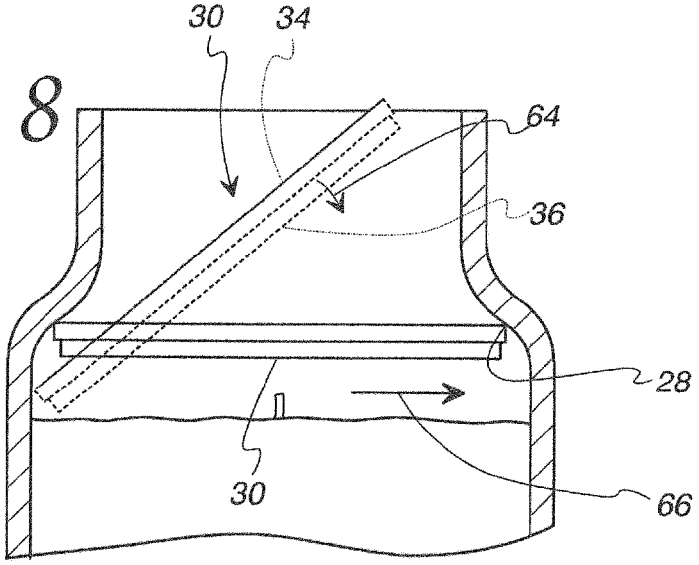
FIG. 8 is a view as in FIG. 7 wherein the security assembly is fully in the securing position.
Figure 10:
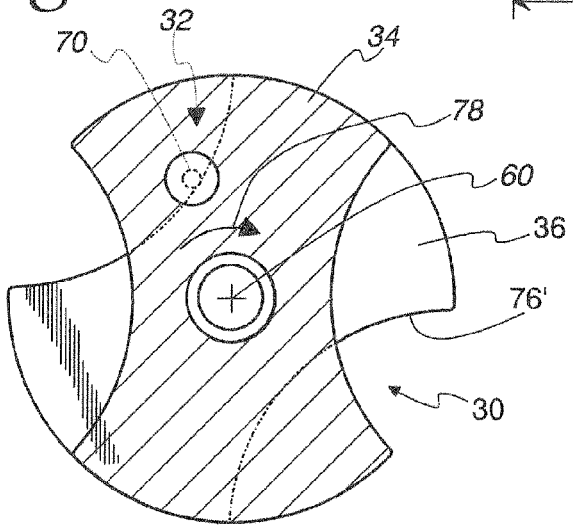
FIG. 10 is a view as in FIG. 9 wherein the security assembly has been changed to a second state wherein it is maintained within the candle receptacle in the securing position.
Figure 11:
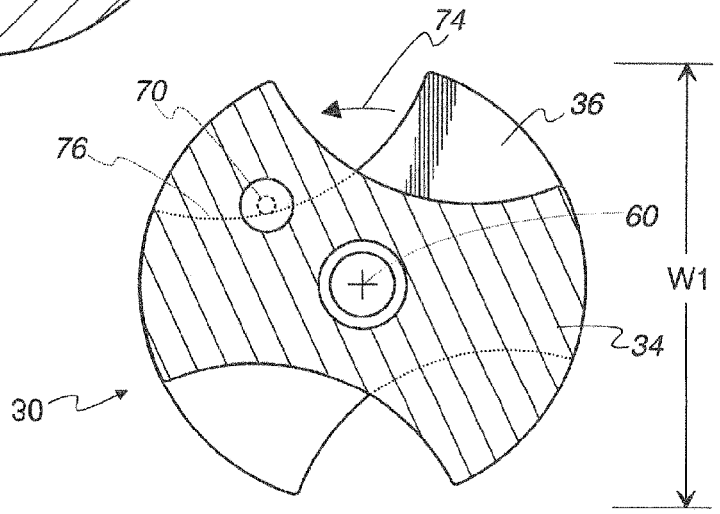
FIG. 11 is a view as in FIG. 10 showing another relationship between the parts and representing the same second state.

Once the securing position, as shown in solid lines in FIG. 8, is realized for the security assembly 30, the parts 34, 36 can be relatively moved to change the security assembly 30 into its second state. FIGS. 10 and 11 represent two different relative positions for the parts 34, 36, wherein the security assembly 30 is in its second state. In each of FIGS. 10 and 11, the parts 34, 36 cooperatively occupy a different area, as viewed along the axis 60, than the parts 34, 36 do with the security assembly 30 in the first state therefor. By relatively moving the parts 34, 36 out of their FIG. 9 relationship, the combined width dimension W for the parts 34, 36 increases progressively up to that shown in each of FIGS. 10 and 11, wherein the security assembly 30 has an effective diameter such that it is not capable of being reoriented to pass through the neck diameter D. The security assembly 30 in each of FIGS. 10 and 11 does not have a dimension, corresponding to the width W, that is capable of passing through the neck 18 as shown in FIG. 7. In this embodiment, the security assembly 30, as shown in FIGS. 10 and 11, has, from all angular perspectives, an effective diameter equal to the length L, which is greater than the diameter D.

The locking assembly 32 consists of a housing 68 on the part 34 with an element 70 that is biased by a spring 72 to project from the housing 68 in a direction generally parallel to the axis 60. The element 70 is normally in the FIG. 12 state wherein it projects through and beyond the part 34 to reside in the path of the part 36 as the parts 34,36 are moved relative to each other around the axis 60.

In FIGS. 10 and 11, the part 34 is shown shaded to clarify its movement relative to part 36. As the part 34 is pivoted relative to the part 36 in one direction as indicated by the arrow 74 around the axis 60, the element 70 abuts to an edge 76 on the part 36. Movement in the opposite direction around the axis 60, as indicated by the arrow 78, causes the element 70 to abut another part of the same edge 76 on the part 36. So long as the element 70 is in its projecting state of FIG. 12, the parts 34, 36 are limited in relative movement between the relationships shown in FIGS. 10 and 11. Throughout this range of movement, the narrowest width W1, corresponding to the width W, is never narrow enough that the security assembly 30 can be passed through the neck 18, regardless of how it is oriented, to allow reversal of the assembly steps shown in FIGS. 7 and 8.

The parts 34, 36 can be relatively moved so that the element 70 cooperates with another edge 76' on the part 36 to produce the same functional configurations.

Figure 12:
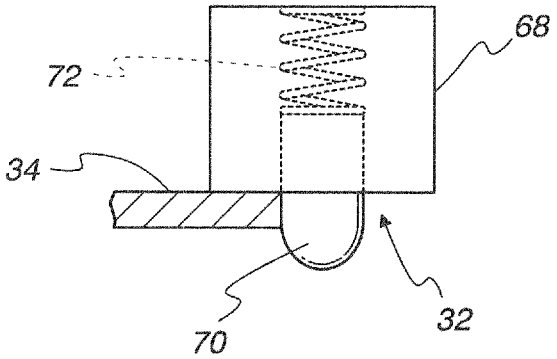
FIG. 12 is an enlarged, fragmentary, side elevation view of the locking assembly on the inventive security assembly and in a locked state.

While the locking assembly 32 is described above to maintain a fixed relationship between the first and second parts 34, 36 in their second state, the locking assembly 32 actually limits the movement between the parts 34, 36 between the relationships in FIGS. 10 and 11. With the parts 34, 36 in a range between the FIG. 10 and FIG. 11 relationships, the security assembly 30 is in its second state. This range is controlled so long as the locking assembly 32 is in the aforementioned locked state, as shown in FIG. 12.

Figure 13:
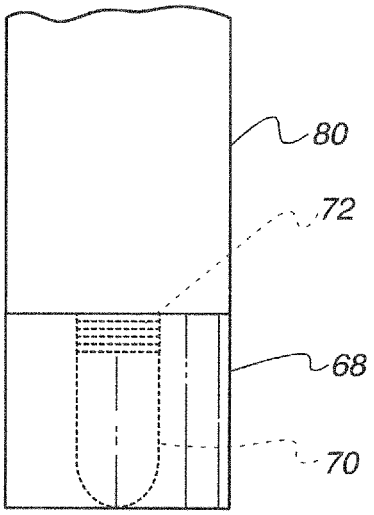
FIG. 13 is a view as in FIG. 12 wherein a tool is used to change the locking assembly from the locked state into a released state.

When it is desired to separate the security assembly 30, a tool 80, as shown in FIG. 13, is utilized to produce a magnetic force upon the element 70, to attract the same to the FIG. 13 state, which represents the released state for the locking assembly 32. Part or all of the element 70 is made with a metal construction or is magnetized to be attracted to the tool 80 to accomplish this.

Once the element 70 is retracted to the FIG. 13 state, the first and second parts 34, 36 can be relatively repositioned to realize the FIG. 9 relationship whereupon the security assembly 30 can be manipulated to be separated from the case 14 by reversing the aforementioned assembly steps.

Significantly, the above structure has been described by defining "diameters" of parts. It is not necessary that the parts and openings produce circular shapes with clearly defined diameters. The invention contemplates making parts with "effective diameters" to achieve the same functional results, even though the parts and the accommodating openings may not be fully round. What is significant is that the "effective diameter" of the security assembly 30 in its second state be large enough to be blocked by the shoulder 28. In its first state, as shown in FIG. 9, the security assembly 30 has an "effective diameter" less than the dimension L whereby it can be passed through the neck diameter D. Any shapes that will allow this end to be achieved are contemplated.

Figure 14:
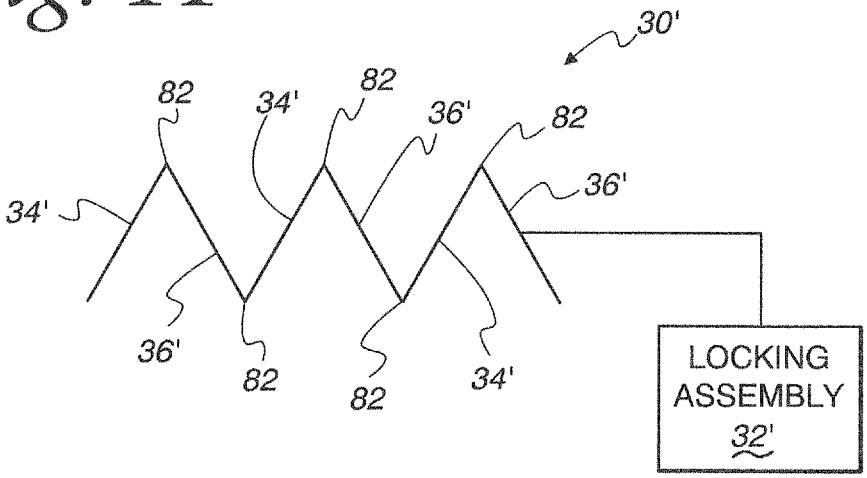
FIG. 14 is a partially schematic, side elevation view of a modified form of security assembly, according to the present invention.

In the depicted embodiment, the first and second parts 34, 36 are separate parts that are movable independently of each other. As shown in FIG. 14 in an alternative form of security assembly 30', corresponding parts 34', 36' might be integrally connected and movable relative to each other, as around fold lines 82. A "fanning"-type arrangement may be produced using this construction. A corresponding locking assembly 32', of suitable construction, may be incorporated to maintain the corresponding second state for the parts 34', 36'.

Figure 15:
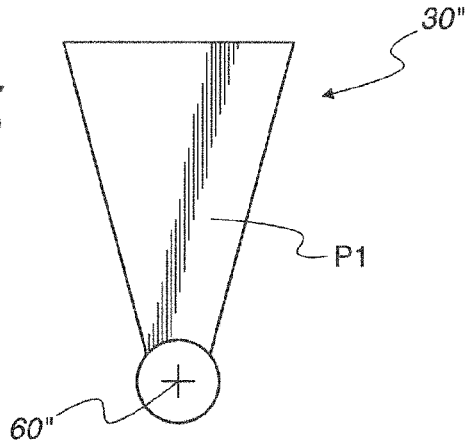
FIG. 15 is a view as in FIG. 9 of a further modified form of security assembly, according to the invention, and with parts thereof in a corresponding first state.
Figure 16:
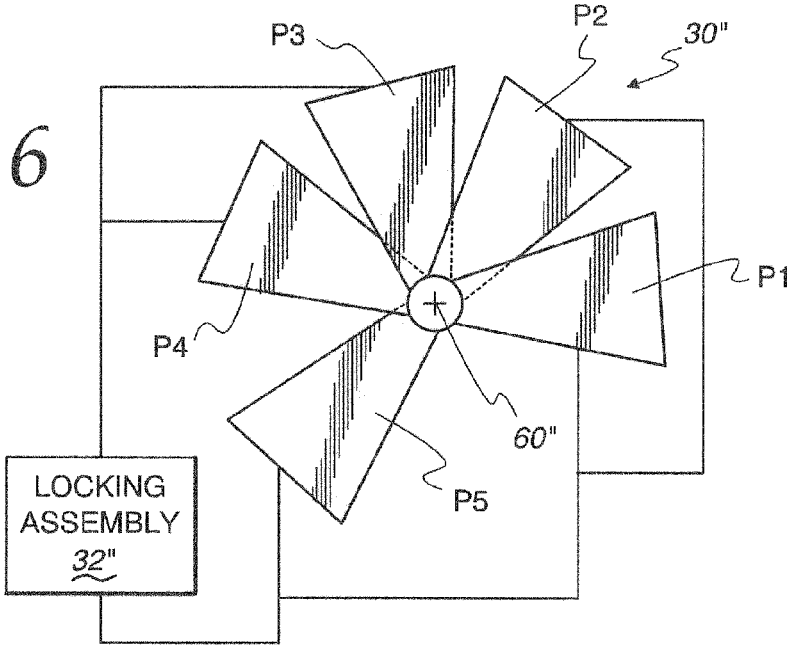
FIG. 16 is a view as in FIG. 15 and with the parts changed to a second state corresponding to that in FIGS. 10 and 11.

In FIGS. 15 and 16, a further modified form of security assembly is shown at 30" having multiple parts P1, P2, P3, P4, P5 corresponding to parts 34, 36, 34', 36'. Any number of the parts P1-P5 might be utilized. Each of the parts P1-P5 has the same configuration, with the parts P1-P5 joined for pivoting around a common axis 60".

In this embodiment, the parts P1-P5 are generally flat triangular shapes with the planes of the plates in parallel and stacked relationship. In FIG. 15, representing the first state for the parts P1-P5, the stacked parts have a generally matched shape, as viewed along the axis 60". By then moving the parts P1-P5 relative to each other around the axis 60", the effective diameter of the security assembly 30" is changed.

Again, a suitable locking assembly 32" can be utilized to maintain a corresponding second state, as shown schematically in FIG. 16.

Figure 17:
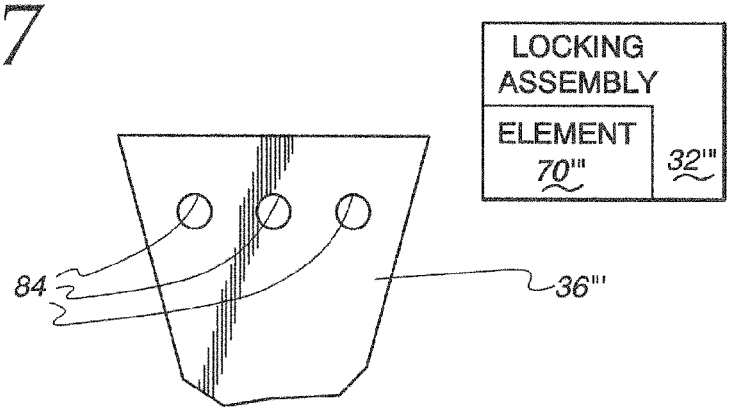
FIG. 17 is a plan view of a part on another security assembly, according to the invention, with a modified form of locking assembly.

In FIG. 17, another modification is shown to a part 36''', corresponding to the part 36, above. In this embodiment, the part 36''' is configured to cooperate with an element 70''', corresponding to the element 70, above. Instead of having the element 70''' abut an edge of the part 36''', one or more, and in this case three, openings 84 are provided for reception of the element 70''' with the associated locking assembly 32''' in a locked state. This allows different configurations to be selected in placing the associated security assembly in its second state.

In FIGS. 18-31, a further modified form of security assembly is shown at 30$^{4'}$ consisting of first and second parts 34$^{4'}$ and 36$^{4'}$, respectively. The security assembly 30$^{4'}$ is usable with the same type of candle 12 for which the other embodiments of the security assembly described herein are designed.

The first and second parts 34$^{4'}$, 36$^{4'}$ can be placed in a joined, operative state, as shown in FIG. 19, by being moved from a separated, pre-assembly relationship, as shown in FIG. 18, towards each other along a line, as indicated by the double-headed arrow 90. Each of the first and second parts 34$^{4'}$ and 36$^{4'}$ has a generally rectangular shape. The first part 34$^{4'}$ has spaced, parallel, U-shaped slots 92, 94 each configured to accept one of two rails 96, 98, respectively, defined by the second part 36$^{4'}$. The rails 96, 98 are defined by the edges of a flat wall 100 making up a part of a body 102 on the second part 36$^{4'}$. The slots 92, 94 are bounded by a flat wall 104 making up part of a body 106 on the first part 34$^{4'}$.

With the parts 34$^{4'}$, 36$^{4'}$ operatively joined, the parts 34$^{4'}$, 36$^{4'}$ have a combined effective length L between edges 108, 110, respectively on the parts 34$^{4'}$, 36$^{4'}$. The edges 108, 110 are curved to nominally match the inside diameter D of the candle neck 18. This, however, is not a requirement. A step 112 is formed adjacent to the edge 110 on the part 364' to facilitate placement of the security assembly 30$^{4'}$, as hereinafter described, and to define a curved blocking edge 113, which performs a function hereinafter described.

The part 34$^{4'}$ has an elongate opening 114 formed through the wall 104. The opening 114 is situated so that the accessible portion of the candle wick 37 can project therethrough with the security assembly 30$^{4'}$ operatively positioned on the candle 12.

The part 36$^{4'}$ has a raised shroud 116 that opens towards the wall 100 and has an open end 118. As the parts 34$^{4'}$, 36$^{4'}$ are advanced towards each other along the line indicated by the double-headed arrow 90, with the accessible portion of the wick 37 projecting through the opening 114, the accessible portion of the wick 37 can pass through the entry opening 118 into a chamber 120 bounded by the shroud 116 so that it does not become damaged.

The part 34$^{4'}$ has a post 122 that projects in cantilever fashion from the wall 104. The post 122 serves two functions. First of all, it is readily graspable to allow manipulation of the part 34$^{4'}$ as it is joined to and controllably moved relative to the part 36$^{4'}$. The post 122 also abuts to the edge 124 of the shroud 116 to limit movement of the parts 34$^{4'}$, 36$^{4'}$ towards each other. As this abutment occurs, the parts 34$^{4'}$, 36$^{4'}$ realize their shortest effective length L. The aforementioned curved blocking edge 113 on the part 36$^{4'}$ simultaneously abuts to a complementarily-shaped edge 117 on the part 34$^{4'}$ in this shortened state to provide a redundant stop.

Figure 22:
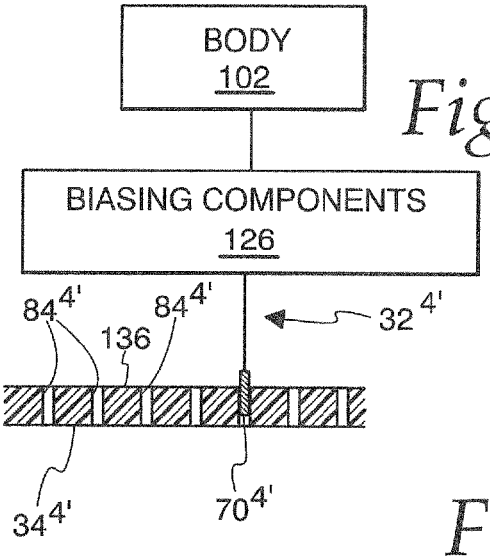
FIG. 22 is a fragmentary, cross-sectional view of one of the security assembly parts taken along line 22-22 of FIG. 18 and showing openings in which a projecting element on the other of the parts can be extended to releasably fix the parts in different relationships.
Figure 23:
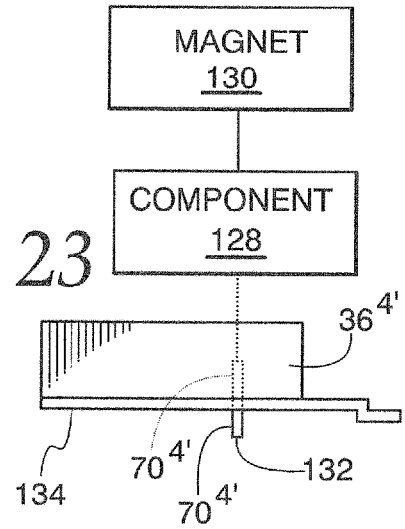
FIG. 23 is an elevation view of the part in FIG. 21.

The security assembly 30$^{4'}$ has a locking assembly 32$^{4'}$ that maintains the first and second parts 34$^{4'}$, 36$^{4'}$ in different relationships such that their combined effective length L is different. The locking assembly 32$^{4'}$ consists of a projecting element 70$^{4'}$ on the part 36 is normally biased to an extended/projecting position, as shown in FIGS. 21-23, away from the body 102 on the part 36$^{4'}$. This represents a locked state for the locking assembly 32$^{4'}$. At least one biasing component 126 normally biases the element 70$^{4'}$ to its extended/projecting position as shown in FIGS. 21-23.

At least one component 128 is associated with the element 70$^{4'}$ so that the generation of a force through a magnet 130 in the vicinity of the component(s) 128 retracts the element 70$^{4'}$ to the dotted line position of FIG. 23 wherein the free end 132 of the element 70$^{4'}$ is substantially flush with a surface 134 on the part 36$^{4'}$. This represents a released state for the locking assembly 32$^{4'}$.

With the parts 34$^{4'}$, 36$^{4'}$ operatively joined, the surface 134 faces, and is guided against, an oppositely facing flat surface 136 on the part 34$^{4'}$. The part 34$^{4'}$ has a series of openings 84$^{4'}$ arranged with their axes substantially in a single plane whereby the element 70$^{4'}$ can project into any one of the openings 84$^{4'}$ releasably fix a desired combined length L through a range of potential lengths L as dictated by the locations of the openings 84$^{4'}$.

By using the magnet 130 to withdraw the projecting element 70, the parts 34$^{4'}$, 36$^{4'}$ can be moved relative to each other along the line indicated by the double-headed arrow 90. Once the desired combined length L is realized, the magnet 130 can be moved away from the component(s) 128, whereupon the biasing component(s) 126 urges the element 70$^{4'}$ towards its projecting position such that it will move into one of the registered openings 84$^{4'}$ to fix the effective combined length L.

The walls 100, 104, with their flat configuration, function as flat plates that reside in spaced, substantially parallel planes. As the joined parts 34$^{4'}$, 36$^{4'}$ are moved relative to each other, the parallel relationship of the walls/plates 100, 104 is maintained through the interaction of the surfaces 134, 136. The overall combined structure has a generally flat shape, with the exception of the projecting shroud 116 and post 122.

The security assembly 30$^{4'}$ functions substantially the same as the other security assemblies described above. That is, in a first state, with the parts 34$^{4'}$, 36$^{4'}$ having a first combined length, the security assembly 30$^{4'}$ is configured to be directed through the neck 18. This is described below in two different manners.

Figure 24:
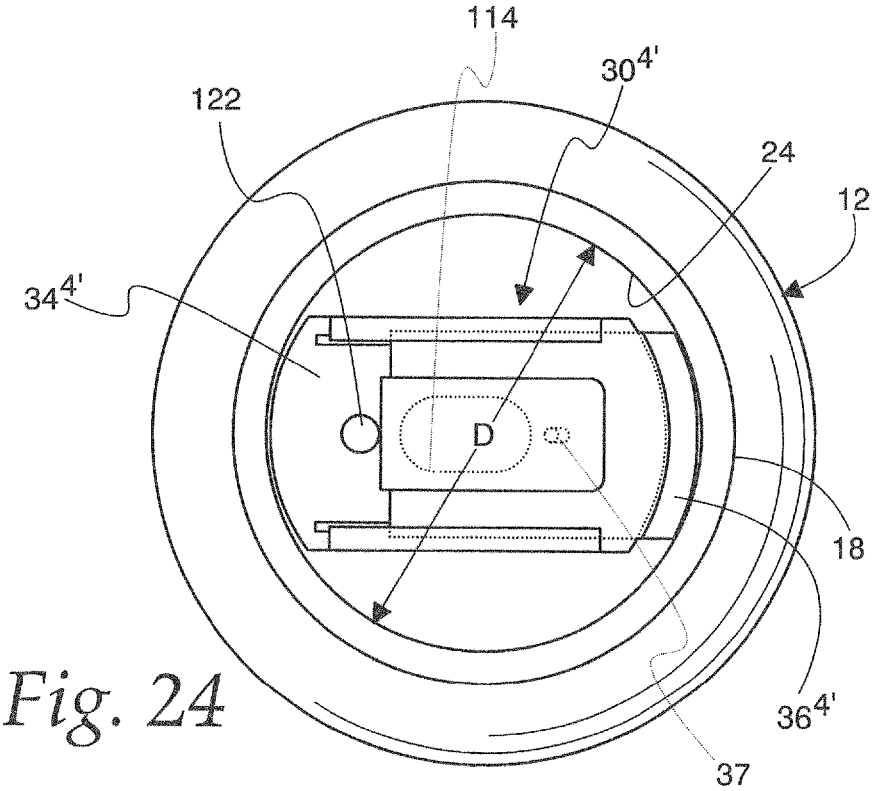
FIG. 24 is a plan view of the candle with the security assembly in FIGS. 18-23 in a first state and being directed through the candle neck.
Figure 25:
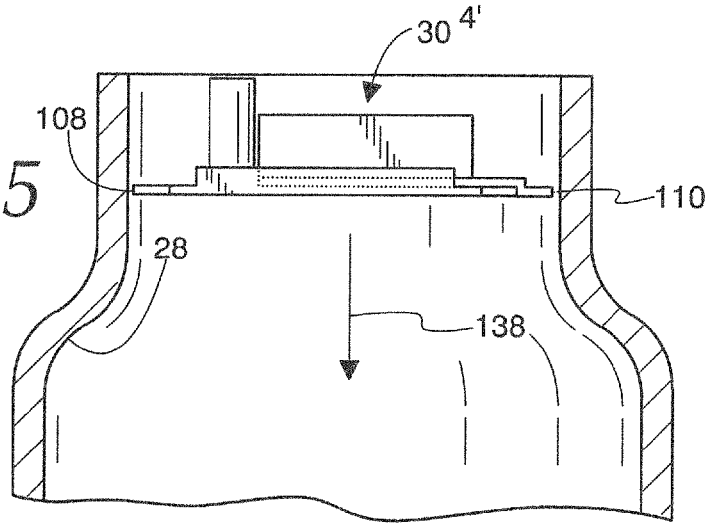
FIG. 25 is a fragmentary, side elevation view showing the security assembly being advanced further downwardly from the FIG. 24 position.
Figure 26:
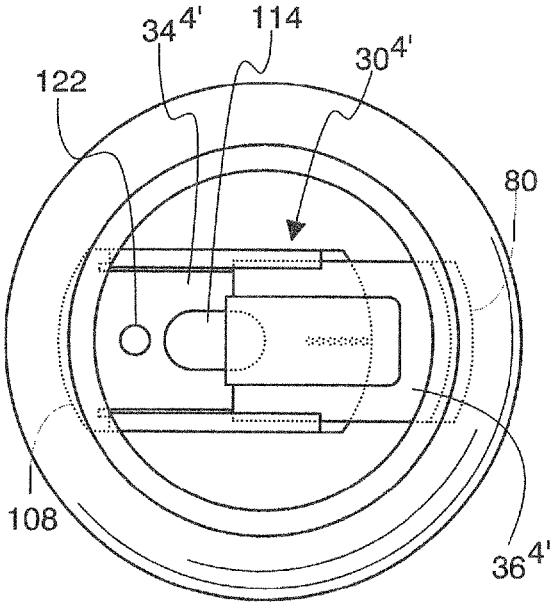
FIG. 26 is a view as in FIG. 24 with the security assembly in a securing position and reconfigured to a second state so as to thereby be secured to the candle.
Figure 27:
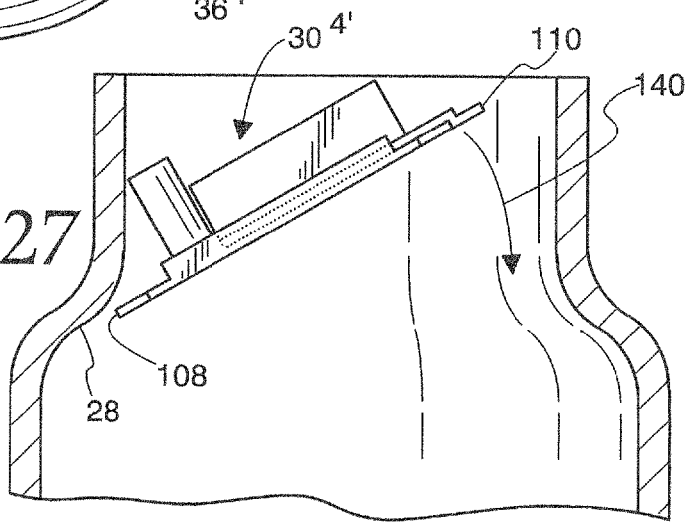
FIG. 27 is a view as in FIG. 25 wherein the security assembly in its first state is installed in a different manner by being initially angled relative to the candle to situate one end, after which the other end is pivoted downwardly.

In FIGS. 24-26, the security assembly 30$^{4'}$ is placed in its first state wherein the length L is less than the effective neck diameter D. In this state, the security assembly 30$^{4'}$ can be situated over the neck opening 24 and advanced in a straight line downwardly, as indicated by the arrow 138 in FIG. 25, until the edges 108, 110 reside beneath the shoulder 28, representing its securing position. The length L can then be extended so that the edges 108, 110 advance to under the shoulder 28. The effective length/diameter of the security assembly 30$^{4'}$ in the second state is greater than the effective diameter of the shoulder 28. The shoulder 28 thus blocks separation of the security assembly $\mathbf{30}^{4'}$ from the candle 12 by movement thereof oppositely to the direction of the arrow 138.

Alternatively, the parts $\mathbf{34}^{4'}$, $\mathbf{36}^{4'}$ can be dimensioned so that the security assembly $\mathbf{30}^{4'}$ in its first state must be angled to allow the edge 108 to reside under the candle shoulder 28, whereupon the end opposite the edge 108 can be tipped downwardly as indicated by the arrow 140 to seat the edge 110 under the shoulder 28 and place the security assembly $\mathbf{30}^{4'}$ in its securing position. The security assembly $\mathbf{32}^{4'}$ can then be changed into its second state.

Whereas the above-described construction requires that the projecting element $\mathbf{70}^{4'}$ be manually retracted to increase the effective length L of the combined parts $\mathbf{34}^{4'}$, $\mathbf{36}^{4'}$, this structure might be modified as shown in FIG. 29 so that the first and second parts $\mathbf{34}^{4'}$, $\mathbf{36}^{4}$ might be lengthened without using the tool with the magnet 130. That is, the second part $\mathbf{36}^{4'}$ may incorporate a one-way camming structure 142 adjacent each opening for the projecting element $\mathbf{70}^{4'}$ that repetitively biases the projecting element $\mathbf{70}^{4'}$ towards its retracted position as the parts $\mathbf{34}^{4'}$, $\mathbf{36}^{4'}$ are moved relative to each other. The tool with the magnet 130 is thus necessary only in shortening the effective length as to release the security assembly $\mathbf{30}^{4'}$ from the candle 12.

As shown in FIG. 30, the security assembly $\mathbf{30}^{4'}$ may incorporate a component $\mathbf{38}^{4'}$, corresponding to the component 38, described above, that cooperates with a sensing system 40 that detects the component $\mathbf{38}^{4'}$. This allows monitoring of the candle 12 with the security assembly $\mathbf{30}^{4'}$ in its securing position and second state. The component might be an EAS tag, or the like.

As with the above-described security assemblies, the security assembly $\mathbf{30}^{4'}$, as shown in FIG. 31, may utilize a tether $\mathbf{42}^{4'}$ secured to the support 44. The length of the tether $\mathbf{42}^{4'}$ determines a range within which the candle 12 can be moved with the security assembly $\mathbf{30}^{4'}$ in the securing position and second state therefor.

The foregoing disclosure of specific embodiments is intended to be illustrative of the broad concepts comprehended by the invention.

The invention claimed is:

1. A candle security system, comprising:

a) a candle having a case bounding a receptacle for a supply of wax in which a wick is embedded, the wick having an accessible portion, the case having a main body and a neck, the neck defining an opening into the receptacle, the opening having a first effective diameter, the case defining a shoulder facing in a first direction with a second effective diameter that is greater than the first effective diameter; and b) a security assembly configured to be placed in first and second different states, the security assembly in the first state configured to be directed through the neck generally in the first direction up to and past the shoulder into a securing position, the security assembly in the first state and securing position changeable into the second state wherein the security assembly has a third effective diameter that is greater than the first effective diameter so that the security assembly is blocked by the shoulder from being moved generally oppositely to the first direction through the neck to be separated from the case, the security assembly configured to accommodate the accessible portion of the wick with the security assembly in the second state.

2. The system according to claim 1 further in combination with a sensing system and the security assembly further comprises a component that is configured to be detected by the sensing system to thereby allow monitoring of the candle with the security assembly in the securing position and second state.

3. The system according to claim 1 wherein the security assembly comprises first and second parts that are movable one relative to the other to thereby change the security assembly between the first and second states.

4. The system according to claim 1 further in combination with a removable cap that is configured to be selectively: a) engaged with the case to block the neck opening; and b) separated from the case.

5. The system according to claim 1 wherein the case has a top and bottom and the neck opening is at the top of the case.

6. The system according to claim 1 wherein the case is made from a glass material.

7. The system according to claim 1 wherein the security assembly comprises an EAS tag.

8. The system according to claim 1 wherein the main body has a substantially cylindrical shape with a first central axis and the neck has a substantially cylindrical shape with a second central axis that is substantially coincident with the first central axis.

9. The system according to claim 1 wherein the security assembly has an opening that is located to receive the accessible portion of the wick with the security assembly in the second state.

10. The system according to claim 1 wherein the security assembly defines a chamber located to receive the accessible portion of the wick with the security assembly in the second state.

11. The system according to claim 3 wherein the security assembly is configured so that the first and second parts are movable guidingly relative to each other along a first line.

12. The system according to claim 3 wherein the security assembly further comprises a tether attached to one of the first and second parts and having a length, the tether configured to be secured to a support to confine movement of the candle to within a range determined by the length of the tether.

13. The system according to claim 3 wherein the security assembly further comprises a locking assembly configured when in a locked state to maintain the first and second parts in a relationship wherein the security assembly is in the second state.

14. The system according to claim 3 wherein the first and second parts each comprises a substantially flat plate with the plates residing in spaced, substantially parallel planes and the first and second parts are movable relative to each other while maintaining a substantially parallel relationship between the planes within which the first and second parts reside.

15. The system according to claim 3 wherein the first and second parts are fully separate parts movable independently of each other.

16. The system according to claim 3 wherein there is an opening in one of the first and second parts that is located to receive the accessible portion of the wick with the security assembly in the second state.

17. The system according to claim 3 wherein one of the first and second parts defines a chamber located to receive the accessible portion of the wick with the security assembly in the second state.

18. The system according to claim 8 wherein the neck blends into the main body at a first transition location at which the shoulder is defined.

19. The system according to claim 11 wherein the first and second parts cooperatively produce an overall flat shape with a combined length along the first line, as viewed along a line normal to a plane of the flat shape that is changed as the security assembly is changed between the first and second states.

20. The system according to claim 11 wherein one of the first and second parts has a cantilevered post that can be grasped to control positioning of the one of the first and second parts.

21. The system according to claim 11 wherein there are rail and slot components on the first and second parts that cooperate to guide relative movement between the first and second parts.

22. The system according to claim 11 wherein the first and second parts are configured so that portions of the first and second parts abut to fix a combined dimension of the first and second parts along the first line.

23. The system according to claim 13 wherein the locking assembly comprises a projecting element on one of the first and second parts that blocks relative movement between the first and second parts with the locking assembly in the locked state.

24. The system according to claim 16 wherein the other of the first and second parts defines a chamber located to receive the accessible portion of the wick with the accessible portion of the wick projecting through the opening in the one of the first and second parts with the security assembly in the second state.

25. The system according to claim 19 wherein the security assembly further comprises a locking assembly configured when in a locked state to maintain the first and second parts in a relationship wherein the security assembly is in the second state.

26. The system according to claim 23 wherein the projecting element is configured to be retracted to change the locking assembly from the locked state into a released state wherein the first and second parts can be moved relative to each other to thereby change the security assembly from the second state into the first state.

27. The system according to claim 24 wherein the security assembly is configured so that the first and second parts are movable guidingly relative to each other along a first line.

28. The system according to claim 25 wherein the locking assembly is configured when in the locked state to maintain the first and second parts in a plurality of different relationships wherein the security assembly is in the second state and the combined lengths of the first and second parts along the first line are different.

29. The system according to claim 26 in combination with a tool that produces a magnetic force, the projecting element configured to be retracted in response to the application of the magnetic force by the tool.

30. The system according to claim 28 wherein the locking assembly comprises a projecting element on one of the first and second parts and a plurality of spaced openings on the other of the first and second parts each to receive the projecting element with the first and second parts in different relationships.

31. The system according to claim 30 wherein the security assembly is configured so that the projecting element can be selectively extended and retracted.

32. The system according to claim 31 wherein the security assembly is configured so that the projecting element is biased into an extended position.

33. The system according to claim 32 wherein the projecting element is configured to be attracted to a magnet that can be placed in the vicinity of the projecting element to thereby retract the projecting element against a force biasing the projecting element into the extended position.

34. The system according to claim 33 further in combination with a magnet that is usable to retract the projecting element.

* * * * *